US010689768B2

(12) United States Patent
Shin et al.

(10) Patent No.: US 10,689,768 B2
(45) Date of Patent: Jun. 23, 2020

(54) AMALGAM ELECTRODE, PRODUCING METHOD THEREOF, AND METHOD OF ELECTROCHEMICAL REDUCTION OF CARBON DIOXIDE USING THE SAME

(71) Applicants: Sogang University Research Foundation, Seoul (KR); Korea Southern Power Co., Ltd., Seoul (KR)

(72) Inventors: Woonsup Shin, Seoul (KR); Sae Young Oh, Seoul (KR); Suk Kyu Kim, Guri-si (KR); Ki Nam Kwon, Yongin-si (KR); Chan Hyo Yu, Seoul (KR); Gwang Gyu Kim, Seoul (KR)

(73) Assignees: SOGANG UNIVERSITY RESEARCH FOUNDATION, Seoul (KR); KOREA SOUTHERN POWER CO., LTD., Seoul (KR)

( * ) Notice: Subject to any disclaimer, the term of this patent is extended or adjusted under 35 U.S.C. 154(b) by 186 days.

(21) Appl. No.: 14/449,771

(22) Filed: Aug. 1, 2014

(65) Prior Publication Data

US 2016/0032470 A1 Feb. 4, 2016

(51) Int. Cl.

| | |
|---|---|
| ***C25B 11/18*** | (2006.01) |
| ***C25B 3/04*** | (2006.01) |
| ***C22C 7/00*** | (2006.01) |
| ***C22C 30/02*** | (2006.01) |
| ***C22C 30/04*** | (2006.01) |

(52) U.S. Cl.

CPC ..... *C25B 11/18* (2013.01); *C22C 7/00* (2013.01); *C22C 30/02* (2013.01); *C22C 30/04* (2013.01); *C25B 3/04* (2013.01)

(58) Field of Classification Search

CPC ..... C25B 3/04; C25B 11/00; C25B 11/04; C25B 11/0405; C25B 11/18; G01N 27/26–27/49; C22C 7/00

See application file for complete search history.

(56) References Cited

U.S. PATENT DOCUMENTS

| | | | | |
|---|---|---|---|---|
| 4,400,247 A * | 8/1983 | Ginatta | C25B 1/00 | 204/244 |
| 4,834,858 A * | 5/1989 | Barber | C25B 3/10 | 204/225 |
| 6,875,337 B1 * | 4/2005 | Schrøder et al. | G01N 27/48 | 204/416 |
| 7,056,431 B2 | 6/2006 | Schroder et al. | | |
| 8,845,877 B2 * | 9/2014 | Cole | C25B 3/04 | 205/448 |

(Continued)

FOREIGN PATENT DOCUMENTS

KR 10-2005-0024547 A 3/2005

OTHER PUBLICATIONS

Amel (Potentiostat-Galvanostat + Polarographic Analyzer, 2014, pp. 1-5, http://amelchem.com/potentiostat-galvanostat-polarographic-analyzer).*

(Continued)

*Primary Examiner* — Alexander W Keeling

(74) *Attorney, Agent, or Firm* — Alexander J. Kim; Greenberg Traurig LLP

(57) ABSTRACT

The embodiments described herein pertain generally to an amalgam electrode, and a producing method of the amalgam electrode, and an electrochemical reduction method of carbon dioxide using the amalgam electrode.

16 Claims, 6 Drawing Sheets

(56) References Cited

U.S. PATENT DOCUMENTS

| | | | | |
|---|---|---|---|---|
| 2004/0020792 | A1* | 2/2004 | Schroder | G01N 27/48 205/794.5 |
| 2008/0223727 | A1* | 9/2008 | Oloman | B01D 53/326 205/413 |
| 2012/0270102 | A1* | 10/2012 | Whitacre | H01G 11/24 429/205 |
| 2015/0218716 | A1* | 8/2015 | Bocarsly | C25B 11/04 205/350 |
| 2015/0252483 | A1* | 9/2015 | Ono | B01J 19/127 204/252 |

OTHER PUBLICATIONS

GE Instruments (Water for Pharmaceutical Purposes, 2008, pp. 1-50, https://www.geinstruments.com/GetLibraryDoc.aspx?id=f559cafa-b33f-4174-add2-a6b9caff8b41).*

Heller ("An Electrochemical Carbon Dioxide Reduction—Oxygen Generation System Having Only Liquid Waste Products", Ionics, 1968), (Year: 1968).*

M. Jitaru et al., "Electrochemical reduction of carbon dioxide on flat metallic cathodes". Journal of Applied Electrochemistry. Aug. 1997, vol. 27, pp. 875-889.

* cited by examiner

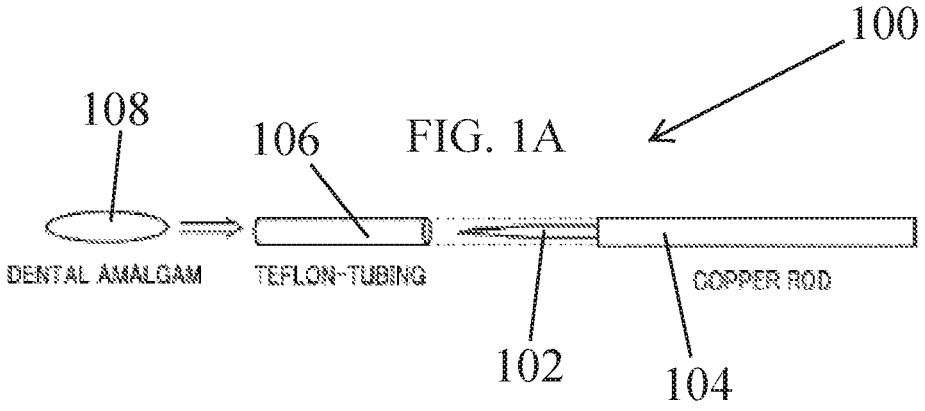
FIG. 1A
FIG. 1B
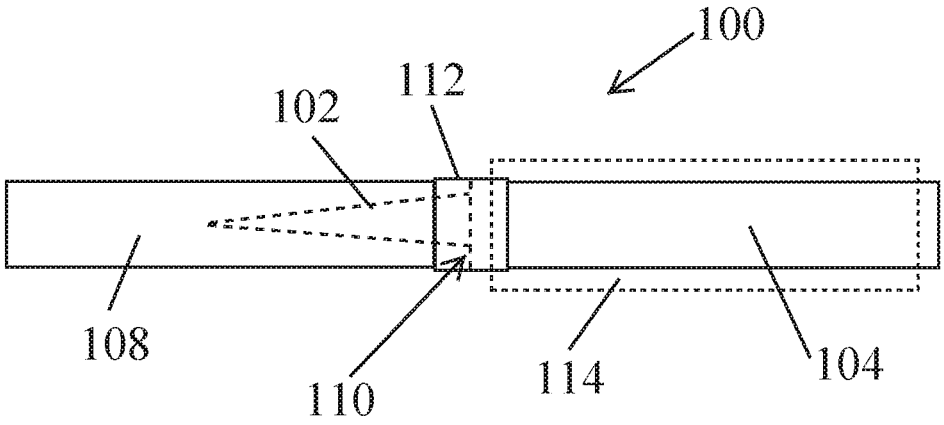

AMALGAM ELECTRODE, PRODUCING METHOD THEREOF, AND METHOD OF ELECTROCHEMICAL REDUCTION OF CARBON DIOXIDE USING THE SAME

TECHNICAL FIELD

The embodiments described herein pertain generally to an amalgam electrode, and in particular, an electrode including dental amalgam, a producing method of the amalgam electrode, and a method of electrochemical reduction of carbon dioxide using the amalgam electrode.

BACKGROUND

Carbon dioxide has been blamed as a primary cause for global warming and is mostly discharged from using fossil fuel. As carbon dioxide is a carbon compound having the lowest energy, input of energy is necessary to convert it into a useful resource, and to this end, various types of energy sources such as hydrogen energy, solar energy and electric energy can be used. Especially, by using the conversion of carbon dioxide using electric energy can convert carbon monoxide, formic acid, methanol, methane, oxalic acid, and others can be converted into various organic compounds by using an electrode reaction under a condition of a room temperature and an atmospheric pressure depending on types of electrode materials and reaction conditions. In this case, since potential differences of reduction of carbon dioxide and generation of hydrogen in an aqueous solution are very close to each other, and the reduction of carbon dioxide is interrupted by the competition of the two reactions, it is necessary to use an electrode having a large overpotential to the generation of hydrogen and a catalyst or electrode surface for selectively converting only carbon dioxide. Thus, as useful materials for the electrode, materials having a large overpotential to the generation of hydrogen have been mostly used. It has been reported that when Hg, In, Sn, Pb, or others are used as an electrode, conversion efficiency into formic acid is high, whereas in case of Zn, Au, Ag, or others, selective conversion efficiency for carbon monoxide is high. Results from using a mercury (Hg) electrode have been reported since 1960s, and it has been reported that when current density is 1 $mA/cm^2$ while using a Hg pool electrode, formic acid is produced with 100% current efficiency. When a Zn amalgam electrode was used, 88.6% current efficiency was achieved for formic acid, and when a Pb amalgam electrode was used, conversion into formic acid was achieved with 90% or more efficiency. In recent, it has been reported that when a Sn electrode is used, formic acid is produced with 63% efficiency. Most electrode materials useful for the conversion into formic acid, except for mercury, cannot be used for a long time due to deactivation of electrode materials themselves. Mercury is advantageous in that since it has the highest hydrogen overpotential, it can achieve the highest efficiency in converting carbon dioxide into formic acid, and furthermore, be stably used for a long time. However, since mercury exists in a liquid state at a room temperature, it is difficult to deal with mercury, and furthermore, if continuously exposed to mercury, toxicity effects such as neural damage and eyesight loss occur, which results in a social environment without using mercury if possible. Thus, people are in the social atmosphere that does not use the mercury if possible. Amalgam is an alloy with mercury, and there are various types of amalgam, among which dental amalgam is being currently used for human beings' oral cavity and assures its safety. Although there have been several attempts to use dental amalgam as an electrode material in the meantime, all the attempts used the dental amalgam for a short-time analysis such as heavy metal analysis using a cathode potential stripping analysis [Korean Patent Application Publication No. 10-2005-0024547].

DISCLOSURE OF THE INVENTION

Problems to be Solved by the Invention

In view of the foregoing, the present disclosure provides an amalgam electrode, especially, including dental amalgam as an electrode material, a producing method of the amalgam electrode, and a method of electrochemical reduction of carbon dioxide using the amalgam electrode.

However, the problems sought to be solved by the present disclosure are not limited to the above description, and other problems can be clearly understood by those skilled in the art from the following description.

Means for Solving the Problems

In a first aspect of the present disclosure provides an amalgam electrode comprising a member selected from the group consisting of Hg, Ag, Sn, Cu, Zn and combinations thereof.

In a second aspect of the present disclosure, a producing method of an amalgam electrode comprises forming an electrode by using amalgam including a member selected from the group consisting of Hg, Ag, Sn, Cu, Zn and combinations thereof.

In a third aspect of the present disclosure, a method of electrochemical reduction of carbon dioxide by using the amalgam electrode of the first aspect of the present disclosure.

Effect of the Invention

The amalgam electrode in accordance with the present disclosure is safe since it uses safe dental amalgam that can overcome the mercury toxicity, and furthermore, since the amalgam electrode can stably electrochemically reduce carbon dioxide to convert it into formic acid for a long time, it is possible to reconvert carbon dioxide into useful materials at low costs, simultaneously with processing carbon dioxide, and thereby, creating high added values.

BRIEF DESCRIPTION OF THE DRAWINGS

FIG. 1A schematically shows a method for forming the amalgam electrode in accordance with an example of the present disclosure, and FIG. 1B shows a portion of the assembled amalgam electrode.

DETAILED DESCRIPTION

Figure 2:
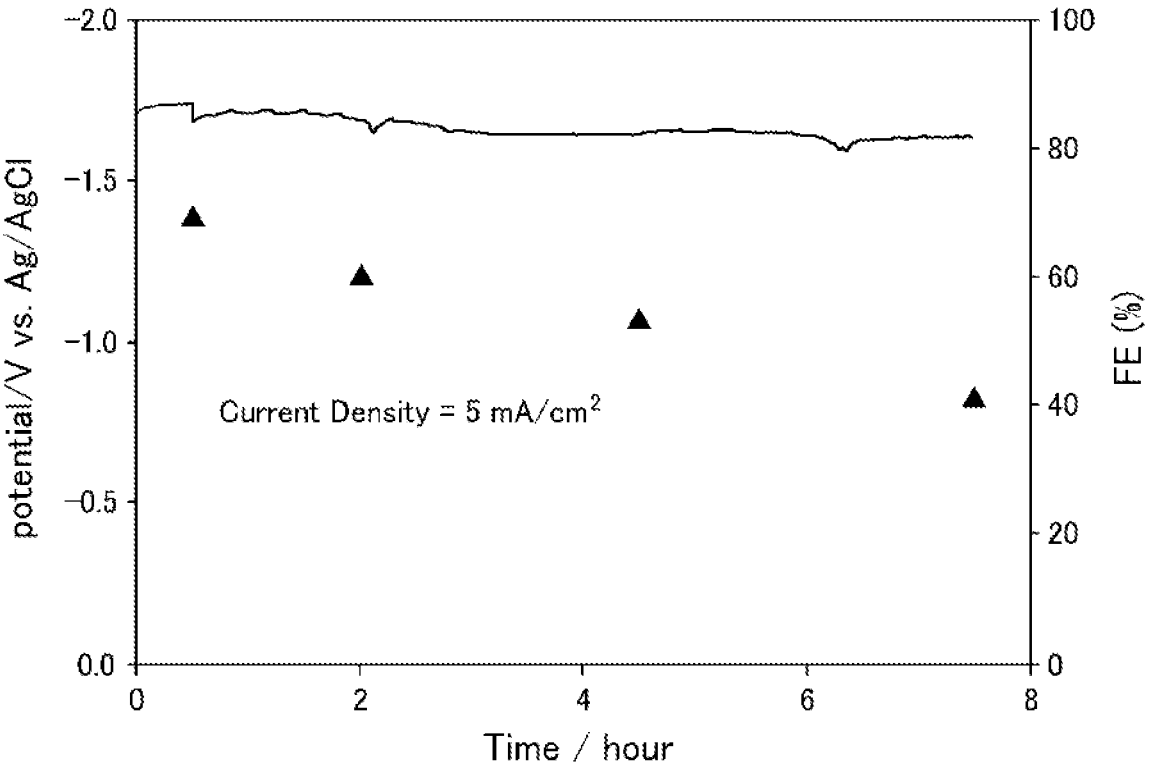
FIG. 2 shows a voltage of the reduction electrode at the time of electrolysis of carbon dioxide using the amalgam electrode in accordance with an example of the present disclosure.

Hereinafter, embodiments of the present disclosure will be described in detail with reference to the accompanying drawings so that inventive concept may be readily implemented by those skilled in the art. However, it is to be noted that the present disclosure is not limited to the embodiments but can be realized in various other ways. In the drawings, certain parts not directly relevant to the description are omitted to enhance the clarity of the drawings, and like reference numerals denote like parts throughout the whole document of the present disclosure.

Throughout the whole document of the present disclosure, the terms "connected to" or "coupled to" are used to designate a connection or coupling of one element to another element and include both a case where an element is "directly connected or coupled to" another element and a case where an element is "electronically connected or coupled to" another element via still another element.

Throughout the whole document of the present disclosure, the term "on" that is used to designate a position of one element with respect to another element includes both a case that the one element is adjacent to the another element and a case that any other element exists between these two elements.

Throughout the whole document of the present disclosure, the term "comprises or includes" and/or "comprising or including" used in the document means that one or more other components, steps, operations, and/or the existence or addition of elements are not excluded in addition to the described components, steps, operations and/or elements. Throughout the whole document of the present disclosure, the terms "about or approximately" or "substantially" are intended to have meanings close to numerical values or ranges specified with an allowable error and intended to prevent accurate or absolute numerical values disclosed for understanding of the present invention from being illegally or unfairly used by any unconscionable third party. Through the whole document of the present disclosure, the term "step of" does not mean "step for."

Throughout the whole document of the present disclosure, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Throughout the whole document of the present disclosure, the expression "A and/or B" means "A or B, or A and B."

Hereinafter, illustrative embodiments and Examples of the present disclosure will be described in detail with reference to the accompanying drawings. However, the present disclosure may not be limited to the illustrative embodiments, the Examples and the drawings.

The first aspect of the present disclosure provides an amalgam electrode comprising a member selected from the group consisting of Hg, Ag, Sn, Cu, Zn, and combinations thereof.

In accordance with an illustrative embodiment of the present disclosure, the amalgam electrode may include Hg of from about 35 wt % to about 55 wt %, Ag of from about 14 wt % to about 34 wt %, Sn of from about 7 wt % to about 17 wt %, and Cu of from about 4 wt % to about 24 wt %, but may not be limited thereto.

In accordance with an illustrative embodiment of the present disclosure, the amalgam electrode may be produced by using dental amalgam, but may not be limited thereto. The dental amalgam may be produced by mixing mercury and amalgam powder with each other, and the amalgam powder may be classified into a low-copper amalgam and a high-copper amalgam according to an amount of Cu. Since the low-copper amalgam is known to be relatively easily subject to corrosion, it would be preferable to use the high-copper amalgam as a final electrode material, but the amalgam powder in the present disclosure may not be limited to the high-copper amalgam. Amalgam is formed by mixing liquid mercury and amalgam powder with each other at a rapid rate by means of an amalgamator, and this process is called an amalgam setting reaction. For example, ANA 2000 amalgam powder of Nordiska contains Ag, Sn, and Cu in amounts of 43.1 wt %, 30.8 wt % and 26.1 wt %, respectively. Dental amalgam is made by mixing amalgam powder with liquid mercury at a weight ratio of 55% for the amalgam powder and 45% for the liquid mercury. For example, dental amalgam may be finally produced with the composition of Hg (45 wt %), Ag (24 wt %), Sn (17 wt %), and Cu (14 wt %). When an amalgam electrode is formed by using dental amalgam, amalgam immediately after its production is like clay, and thus, can be processed to have a desired shape.

In accordance with an illustrative embodiment of the present disclosure, the amalgam electrode may be formed in various shapes according to necessity, and for example, a rod or planar shape, but may not be limited thereto. In addition, the amalgam electrode may further comprise a copper or tin electrode on one side thereof so as to enable the amalgam to well conduct electricity, but the present disclosure may not be limited thereto.

The second aspect of the present disclosure, producing method of an amalgam electrode comprises forming an electrode by using amalgam including a member selected from the group consisting of Hg, Ag, Sn, Cu, Zn and combinations thereof.

In accordance with an illustrative embodiment of the present disclosure, the amalgam electrode including Hg of from about 35 wt % to about 55 wt %, Ag of from about 14 wt % to about 34 wt %, Sn of from about 7 wt % to about 17 wt %, and Cu of from about 4 wt % to about 24 wt %, but may not be limited thereto.

In accordance with an illustrative embodiment of the present disclosure, the amalgam electrode may be produced by using dental amalgam, but may not be limited thereto. The dental amalgam may be produced by mixing mercury and amalgam powder with each other, and the amalgam powder may be classified into a low-copper amalgam and a high-copper amalgam according to an amount of Cu. Since the low-copper amalgam is known to be relatively easily subject to corrosion, it would be preferable to use the high-cupper amalgam as a final electrode material, but the amalgam powder in the present disclosure may not be limited to the high-copper amalgam. Amalgam is formed by mixing liquid mercury and the amalgam powder with each other at a rapid rate by means of an amalgamator, and this process is called an amalgam setting reaction. For example, ANA 2000 amalgam powder of Nordiska contains Ag, Sn, and Cu in amounts of 43.1 wt %, 30.8 wt % and 26.1 wt %, respectively. Dental amalgam is made by mixing the amalgam powder with liquid mercury at a weight ratio of 55% for the amalgam powder and 45% for the liquid mercury. For example, dental amalgam may be finally produced with the composition of Hg (45 wt %), Ag (24 wt %), Sn (17 wt %), and Cu (14 wt %). When the amalgam electrode is formed by using dental amalgam, the amalgam immediately after its production is like clay, and thus, can be processed to have a desired shape.

In accordance with an illustrative embodiment of the present disclosure, the amalgam electrode may be produced in various shapes according to necessity, and for example, a rod or planar shape, but may not be limited thereto. In addition, the producing method of an amalgam electrode may further include forming a copper or tin electrode on one side of the amalgam electrode so as to enable the amalgam to easily conduct electricity, but may not be limited thereto.

For example, FIGS. 1A and 1B shows forming an amalgam electrode 100 in a rod shape. After a front part 102 of a copper rod 104 is processed to be a sharp point, it fits into a Teflon tubing 106, and the void space between the copper rod 104 and the tubing 106 is filled with dental amalgam 108. Curing of the amalgam 108 is completed by about 90% or more after lapse of about 24 hours from the formation of the amalgam, and the Teflon tubing 106 may be removed after about 48 hours for complete curing such that the amalgam 108 can be used as an electrode 100. The copper rod 104 enables the amalgam 108 to well conduct electricity, and simultaneously, serves as a support. Further, in order to a prevent reaction of the copper rod 104 at the time of electrolysis, a boundary 110 between the amalgam 108 and the copper rod 104 may be sealed with a Teflon tape 112 and a heat shrinkable tube 114 so that copper 104 can be prevented from being exposed to a solution.

For example, an amalgam electrode in a planar shape is formed by pushing amalgam, which has been mixed by an amalgamator, into a corresponding space of a mold made of acryl, stainless steel or others and having an appropriate size. In order to make the flat surface of the electrode, an instrument like a chisel capable of applying a force uniformly to the whole surface may be used. In addition, for electric connection, conductors in various shapes like a copper plate may be added to the mold for the production of the amalgam electrode. The planar amalgam electrode is also used after curing of the amalgam for at least 24 hours.

The third aspect of the present disclosure, a method of electrochemical reduction of carbon dioxide by using the amalgam electrode of the first aspect of the present disclosure.

In accordance with an illustrative embodiment of the present disclosure, the method of electrochemical reduction of carbon dioxide may include supplying a solution containing carbon dioxide into a reduction electrode unit in an electrochemical reactor, and applying current to a working electrode including an amalgam electrode and a counter electrode to reduce carbon dioxide, but may not be limited thereto.

In accordance with an illustrative embodiment of the present disclosure, the solution may include a member selected from the group consisting of $KHCO_3$, $NaHCO_3$, $K_2SO_4$, NaCl, KCl and combinations thereof but may not be limited thereto.

In accordance with an illustrative embodiment of the present disclosure, the current ranges from about from about 2 mA/cm$^2$ to about 50 mA/cm$^2$, from about 2 mA/cm$^2$ to about 40 mA/cm$^2$, from about 2 mA/cm$^2$ to about 30 mA/cm$^2$, from about 2 mA/cm$^2$ to about 20 mA/cm$^2$, from about 2 mA/cm$^2$ to about 10 mA/cm$^2$, from about 10 mA/cm$^2$ to about 50 mA/cm$^2$, from about 20 mA/cm$^2$ to about 50 mA/cm$^2$, from about 30 mA/cm$^2$ to about 50 mA/cm$^2$, or from about 40 mA/cm$^2$ to about 50 mA/cm$^2$, but may not be limited thereto.

In accordance with an illustrative embodiment of the present disclosure, carbon dioxide can be converted into formic acid by the method for electrochemical reduction of carbon dioxide, and the conversion current efficiency may be about 50% or more, and for example, but may not be limited thereto, about 60% or more, about 70% or more, about 80% or more, about 90% or more, or from about 55% to about 95%, from about 60% to about 95%, from about 70% to about 95%, from about 80% to about 95%, from about 55% to about 90%, from about 55% to about 80%, from about 55% to about 70%, or from about 55% to about 60%.

Hereinafter, preferable Examples of the present disclosure are described. However, the Examples are merely illustrative for understanding of the present disclosure, and the present disclosure is not limited to the Examples.

EXAMPLES

Example 1: Production of a Rod-Shaped Amalgam Electrode

An amalgam electrode was produced by using the ANA 2000 amalgam powder of Nordiska. liquid mercury of 0.32 g and 0.36 g amalgam powder were mixed with each other at a rapid rate by using an amalgamator to form the amalgam.

The as-formed amalgam was molded by using a Teflon tubing and a copper rod, as illustrated in FIGS. 1A and 1B. After a front part of the copper rod was processed to be a sharp point, it fitted into the Teflon tubing, and the void space between the copper rod and the tubing was filled with dental amalgam. After the Teflon tubing was removed after about 48 hours, the boundary between the amalgam and the copper rod was sealed with a Teflon tape and a heat shrinkable tube.

Example 2: Production of a Planar Amalgam Electrode

After a mold, in which an electrode could be placed, was made by using acryl, small hole was formed on the opposite side of the mold such that the copper rod for conduction of electricity could be inserted into the hole. An amalgam electrode was formed to have a size of 1 cm×10 cm, an area of 10 cm$^2$, and a height of 1 mm. Amalgam was produced to have an appropriate size by using an amalgamator and pushed into the corresponding space of the acryl mold through a force. In this case, since it is important to make the electrode as flat as possible, the surface of the electrode was made flat by using an instrument made of stainless steel and capable of uniformly distributing the force like a chisel. The copper rod was inserted into the hole already formed on the opposite side of the electrode so that the electrode could be electrically connected. After the amalgam was cured for at least 24 hours, a boundary surface between the portion filled with the amalgam and the acryl was filled with epoxy in order to prevent water from being penetrated into the boundary.

Test Example 1

Figure 6:
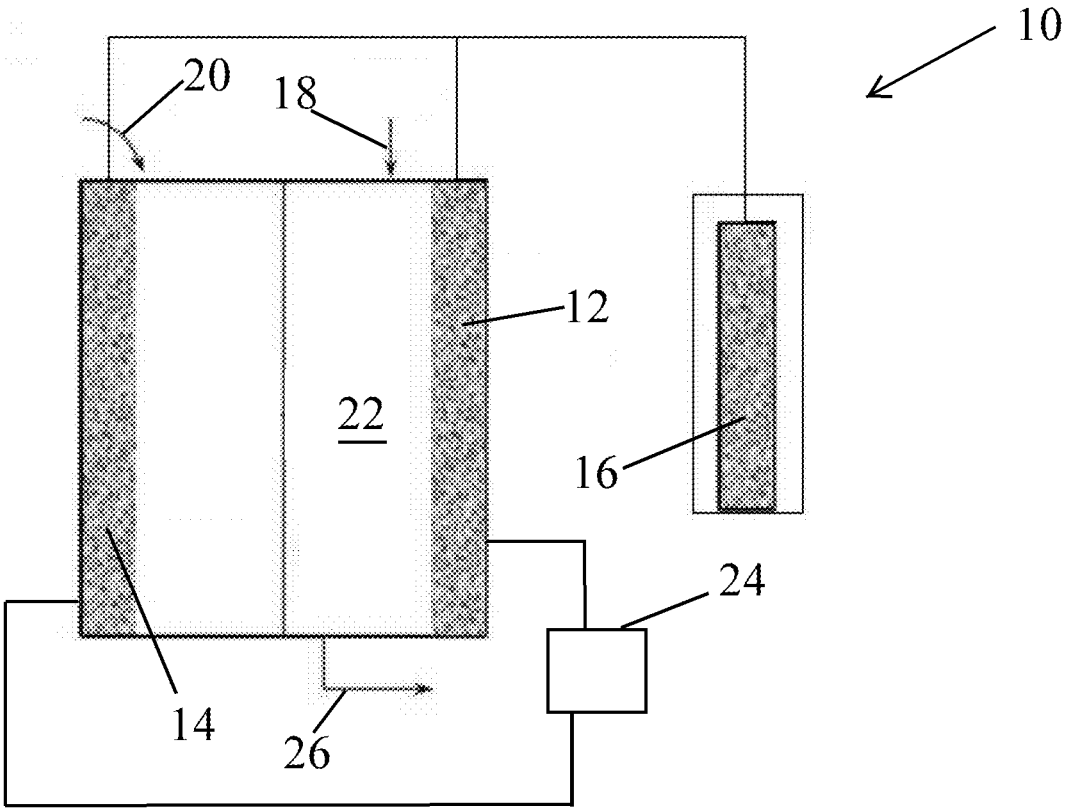
FIG. 6 shows a schematic of an electrochemical cell according to one or more aspects of the present invention.

Electrolysis of carbon dioxide was conducted by using an H-type cell 10 shown in FIG. 6. The rod-shaped amalgam electrode 12 produced in Example 1 was used as a working electrode for reduction of carbon dioxide, a platinum electrode was used as a counter electrode 14, and an Ag/AgCl electrode was used as a reference electrode 16. During the electrolysis, carbon dioxide 18 was continuously flown into and dissolved in the solution in order to supply sufficient carbon dioxide to the reduction electrode unit, and simultaneously, Ar gas 20 was flown into the oxidation electrode unit. The solution 22 of the reduction electrode unit varies depending on experimental examples, but 0.5M $KHCO_3$ was used herein unless otherwise described herein. For the experimentation method, a galvanostat 24 of a current density of 5 mA/cm$^2$ was used unless otherwise described herein. A potential value of the amalgam electrode 12 according to the time was monitored, and formic acid or formate salt 26 (HCOOK or HCOONa) was quantitatively analyzed through liquid chromatography.

In Case of Using 0.5 M $KHCO_3$ as an Electrolyte

Carbon dioxide was electrolyzed by using 0.5 M $KHCO_3$ as an electrolyte and applying static current of 5 mA/cm$^2$, and FIG. 2 provides the results of the electrolysis. As illustrated in FIG. 2, it was identified that the reduction of carbon dioxide was proceeded with at a potential of about −1.8 V vs. Ag/AgCl. While the conversion current efficiency to formic acid was high with 65% for the initial one (1) hour, it was continuously reduced to 50% or less after 4 hours and further continuously reduced thereafter. A current efficiency of 60% was achieved when electrolysis was conducted for one (1) hour, by using the electrode already used for ten (10) hours in the present Example Embodiment, under the condition of a newly produced 0.5 M $KHCO_3$ electrolyte, and it was found that the reduction of the current efficiency resulting from the electrolysis for a long time affects accumulation of a formate salt in the electrolysis solution, in addition to the deterioration of the performance of the amalgam electrode.

In Case of Using 0.5 M $KHCO_3$ Containing 2M KCl as an Electrolyte

Figure 3:
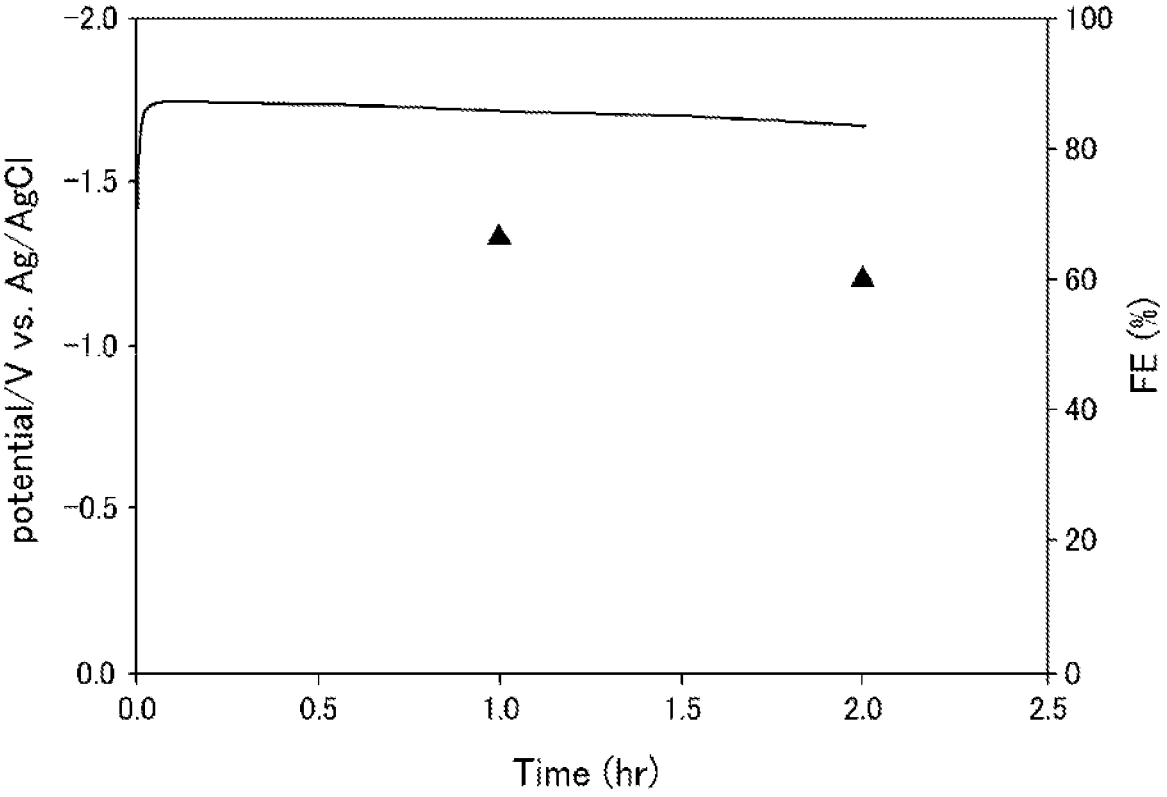
FIG. 3 is a graph showing a voltage of the reduction electrode at the time of electrolysis of carbon dioxide using the amalgam electrode in accordance with an example of the present disclosure.

In order to improve the conductivity, the electrochemical reduction of carbon dioxide was conducted by adding 2M KCl to the electrolyte, and FIG. 3 provides the results of the reduction. As illustrated in FIG. 3, a potential value of the electrode was stably maintained while exhibiting a current efficiency of from 60% to 70% for the initial two (2) hours.

In Case of Using 0.5 M $NaHCO_3$ Containing 0.5M NaCl as an Electrolyte

Figure 4:
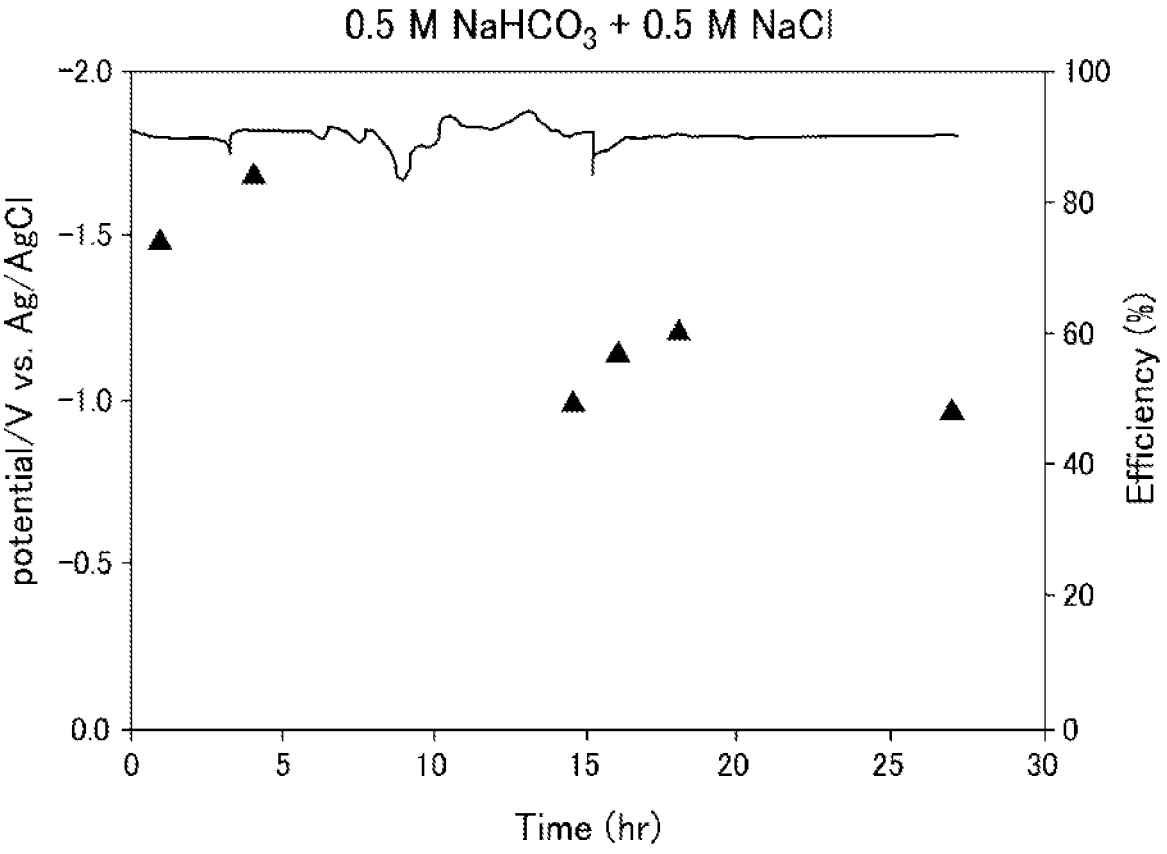
FIG. 4 is a graph showing a voltage of the reduction electrode at the time of electrolysis of carbon dioxide using the amalgam electrode in accordance with an example of the present disclosure.

Electrochemical reduction of carbon dioxide was conducted by changing a cation in the electrolyte into sodium ($Na^+$), and FIG. 4 provides the results of the reduction. As illustrated in FIG. 4, a current efficiency of 80% was exhibited for the initial one (1) hour, but deteriorated as the time lapsed. The potential value of the amalgam electrode was constantly maintained for twenty-five (25) hours, and in this case, the current efficiency was 50%, and 0.5M formic acid was finally produced. The solubility of sodium bicarbonate ($NaHCO_3$) was a quarter of the solubility of potassium bicarbonate ($KHCO_3$) (solubility of sodium bicarbonate: 9.6 g/100 mL; solubility of potassium bicarbonate: 33.7 g/100 mL), and thus the electrolysis was proceeded with the precipitation of sodium bicarbonate was observed.

Test Example 2

Figure 5:
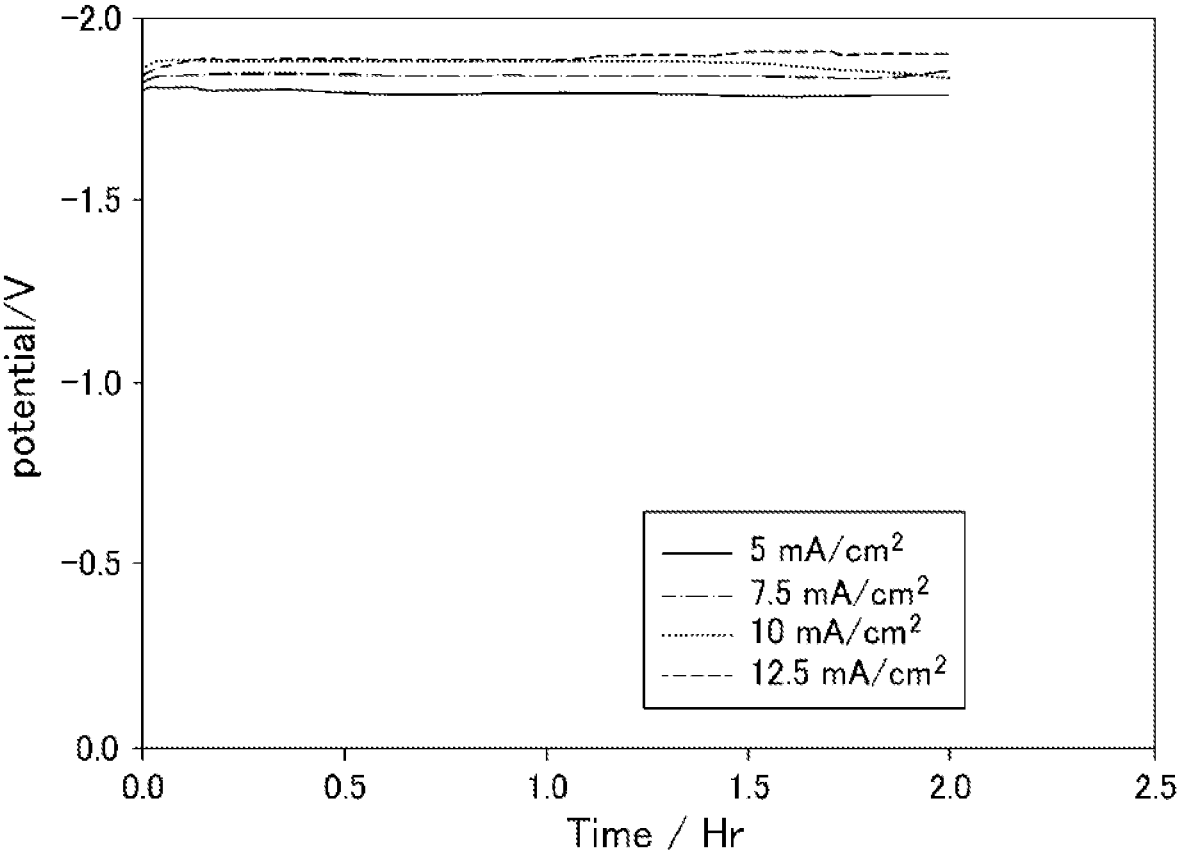
FIG. 5 is a graph showing a voltage of the reduction electrode at the time of electrolysis of carbon dioxide using the amalgam electrode in accordance with an example of the present disclosure.

Electrochemical reduction of carbon dioxide was conducted by using the amalgam electrode produced in Example 1 and changing the current density from 5 mA/cm$^2$ to 12.5 mA/cm$^2$, and resulting effects were evaluated (FIG. 5). As illustrated in FIG. 5, it was observed that as the current density increases, the potential value tends to move toward a negative direction. The current efficiency was 87% when the current density was 5 mA/cm$^2$, 83% when the current density was 7.5 mA/cm$^2$, 80% when the current density was 10 mA/cm$^2$, and 63% when the current density was 12.5 mA/cm$^2$. It could be identified that as the current density increases, more carbon dioxide can be reduced for the same period, but simultaneously, generation of hydrogen more easily occurs, and thereby, generally decreasing the efficiency. In case of the amalgam electrode of the present disclosure, it was confirmed that even when the electrolysis was conducted with current density of from 5 mA/cm$^2$ to 10 mA/cm$^2$, generation of hydrogen did not easily occur, and the reduction of carbon dioxide easily occurred.

The above description of the present disclosure is provided for the purpose of illustration, and it would be understood by those skilled in the art that various changes and modifications may be made without changing technical conception and essential features of the present disclosure. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the example embodiments. It shall be understood that all modifications and embodiments conceived from the meaning and scope of the claims and their equivalents are included in the scope of the inventive concept.

We claim:

1. An electrochemical cell for electrochemical reduction of carbon dioxide comprising:

a reduction electrode unit comprising an amalgam electrode configured to reduce carbon dioxide that flows to the amalgam electrode so as to form at least one of formic acid and formate salt, the amalgam electrode comprising:

a conductive portion, a support portion having a first end that is directly connected to the conductive portion, and a second end oppositely disposed from the first end, the conductive portion being thicker than the second end of the support portion, and an amalgam portion supported by and in direct contact with the support portion, the amalgam portion comprising:

from about 35 wt % to about 55 wt % mercury;

from about 14 wt % to about 34 wt % silver;

from about 7 wt % to about 17 wt % tin; and from about 4 wt % to about 24 wt % copper, an oxidation electrode unit comprising a counter electrode operably connected to the amalgam electrode;

a solution at least partially contacting the amalgam portion of the amalgam electrode, the solution comprising dissolved carbon dioxide and an electrolyte selected from the group consisting of $KHCO_3$, $NaHCO_3$, $K_2SO_4$, NaCl, KCl and combinations thereof;

a source of carbon dioxide configured to flow carbon dioxide into the solution; and a galvanostat configured to apply a static current ranging from 2 mA/cm$^2$ to 10 mA/cm$^2$ between the amalgam electrode and the counter electrode when in operation to reduce the carbon dioxide.

2. The electrochemical cell of claim 1, wherein the amalgam electrode is a rod shape.

3. The electrochemical cell of claim 1, wherein the conductive portion is disposed on one side of the amalgam electrode.

4. The electrochemical cell of claim 1, wherein the electrochemical cell comprises a H-type cell.

5. The electrochemical cell of claim 1, wherein the reduction electrode unit and the oxidation electrode unit are separated by a membrane.

6. The electrochemical cell of claim 1, wherein the amalgam electrode comprises from about 35 wt % to about 45 wt % mercury.

7. The electrochemical cell of claim 1, wherein the solution comprises $KHCO_3$.

8. The electrochemical cell of claim 1, wherein the solution comprises $NaHCO_3$ and NaCl.

9. The electrochemical cell of claim 1, wherein a boundary between the conductive portion and the amalgam portion is sealed with polytetrafluoroethylene tape.

10. The electrochemical cell of claim 1, wherein a boundary between the conductive portion and the amalgam portion is sealed with a heat shrinkable tube.

11. The electrochemical cell of claim 1, wherein a boundary between the conductive portion and the amalgam portion is sealed with an epoxy.

12. The electrochemical cell of claim 1, wherein the amalgam electrode is a planar shape.

13. The electrochemical cell of claim 1, wherein the conductive portion is rod-shaped, and the amalgam portion surrounds the second end of the support portion.

14. The electrochemical cell of claim 1, wherein the amalgam portion includes a flat surface.

15. The electrochemical cell of claim 1, wherein when in operation, the galvanostat applies a static current ranging from 2 $mA/cm^2$ to 10 $mA/cm^2$ between the amalgam electrode and the counter electrode and reduces the carbon dioxide in the solution.

16. A method for electrochemical reduction of carbon dioxide, comprising:

reducing carbon dioxide in a solution of a reduction electrode unit, the reduction electrode unit comprising an amalgam electrode, by supplying a static current ranging from 2 $mA/cm^2$ to 10 $mA/cm^2$ between the amalgam electrode and a counter electrode in the solution of the reduction electrode unit, wherein the solution comprises the carbon dioxide and an electrolyte selected from the group consisting of $KHCO_3$, $NaHCO_3$, $K_2SO_4$, NaCl, KCl and combinations thereof, wherein the amalgam electrode comprises:

a conductive portion, a support portion having a first end that is directly connected to the conductive portion, and a second end oppositely disposed from the first end, the conductive portion being thicker than the second end of the support portion, and an amalgam portion supported by and in direct contact with the support portion, the amalgam portion comprising:

from about 35 wt % to about 55 wt % mercury, from about 14 wt % to about 34 wt % silver, from about 7 wt % to about 17 wt % tin, and from about 4 wt % to about 24 wt % copper.

* * * * *